US011945617B2

(12) United States Patent
Cicchitti

(10) Patent No.: US 11,945,617 B2
(45) Date of Patent: Apr. 2, 2024

(54) WETTING UNIT AND FORMING MACHINE AND METHOD FOR PRODUCING UNIT DOSE ARTICLES

(71) Applicant: Fameccanica.Data S.p.A., San Giovanni Teatino (IT)

(72) Inventor: Anselmo Cicchitti, San Giovanni Teatino (IT)

(73) Assignee: Fameccanica.Data S.p.A.

( * ) Notice: Subject to any disclaimer, the term of this patent is extended or adjusted under 35 U.S.C. 154(b) by 0 days.

(21) Appl. No.: 18/071,706

(22) Filed: Nov. 30, 2022

(65) Prior Publication Data

US 2023/0174259 A1 Jun. 8, 2023

(30) Foreign Application Priority Data

Dec. 3, 2021 (EP) ..... 21212311

(51) Int. Cl.

| | |
|---|---|
| ***B65B 9/04*** | (2006.01) |
| ***B65B 3/02*** | (2006.01) |
| ***B65B 47/00*** | (2006.01) |
| ***B65B 51/02*** | (2006.01) |

(52) U.S. Cl.

CPC ..... *B65B 51/02* (2013.01); *B65B 3/022* (2013.01); *B65B 9/042* (2013.01); *B65B 47/00* (2013.01)

(58) Field of Classification Search

CPC ..... B65B 3/022; B65B 9/042; B65B 47/00; B65B 51/02; B65B 65/46; B65D 81/3261; C11D 17/042; C11D 17/045

See application file for complete search history.

(56) References Cited

U.S. PATENT DOCUMENTS

| | | | | |
|---|---|---|---|---|
| RE29,937 | E * | 3/1979 | Mahaffy | B65B 9/042 53/511 |
| 11,225,348 | B2 * | 1/2022 | Brandt Sanz | C11D 17/043 |
| 11,440,692 | B2 * | 9/2022 | Crivolio | B65B 61/08 |
| 11,590,673 | B2 * | 2/2023 | Waterman | B65B 61/10 |
| 2006/0260973 | A1 * | 11/2006 | Macinnes | C08L 3/04 206/528 |
| 2012/0235329 | A1 * | 9/2012 | Fowler | B65B 47/10 425/388 |
| 2015/0336691 | A1 * | 11/2015 | Fowler | B65D 65/46 53/553 |
| 2016/0068285 | A1 * | 3/2016 | Fowler | B65D 65/46 53/558 |

(Continued)

FOREIGN PATENT DOCUMENTS

| | | | | |
|---|---|---|---|---|
| EP | 1641865 B1 * | 3/2010 | ..... | B29C 65/00 |

OTHER PUBLICATIONS

European Search Report dated May 18, 2022. 5 pages.

*Primary Examiner* — Thomas M Wittenschlaeger
*Assistant Examiner* — David G Shutty
(74) *Attorney, Agent, or Firm* — RMCK Law Group PLC

(57) ABSTRACT

A wetting unit for wetting a surface of one of a first and a second continuous water-soluble films to be coupled and sealingly joined to each other so as to delimit therebetween recesses containing dosed quantities of at least one fluid composition for producing unit dose articles. The wetting unit is configured to wet only surface areas of one of the first and second continuous water-soluble films which are to be joined to the other of the first and second continuous water-soluble films.

5 Claims, 4 Drawing Sheets

(56) References Cited

U.S. PATENT DOCUMENTS

| | | | | |
|---|---|---|---|---|
| 2016/0114914 | A1* | 4/2016 | Kepinski | B65B 1/02 53/436 |
| 2016/0362200 | A1* | 12/2016 | Brandt Sanz | B65B 39/007 |
| 2017/0095586 | A1* | 4/2017 | Loebertmann | A61L 9/012 |
| 2017/0101203 | A1* | 4/2017 | Waterman | B65B 9/042 |
| 2017/0101204 | A1* | 4/2017 | Waterman | B65B 47/02 |
| 2017/0298216 | A1* | 10/2017 | Labeque | B65D 81/3261 |
| 2018/0050826 | A1* | 2/2018 | Hartman | B65D 65/46 |
| 2018/0134431 | A1* | 5/2018 | Thienst | B65B 55/04 |
| 2018/0290774 | A1* | 10/2018 | Fowler | B65B 9/042 |
| 2020/0362277 | A1* | 11/2020 | Meier | B29C 66/433 |
| 2021/0300609 | A1* | 9/2021 | Magnani | B65B 9/042 |
| 2022/0186156 | A1* | 6/2022 | Courchay | C11D 11/0017 |
| 2022/0186157 | A1* | 6/2022 | Courchay | C11D 11/0017 |
| 2022/0396384 | A1* | 12/2022 | Thaler | B65B 51/026 |
| 2023/0174256 | A1* | 6/2023 | Brandt Sanz | B65B 9/023 53/434 |
| 2023/0174259 | A1* | 6/2023 | Cicchitti | B65B 51/02 53/453 |

* cited by examiner

WETTING UNIT AND FORMING MACHINE AND METHOD FOR PRODUCING UNIT DOSE ARTICLES

CROSS-REFERENCE TO RELATED APPLICATION

This application claims priority to European Patent Application No. 21212311.1 filed Dec. 3, 2021. The disclosure of the above application is incorporated herein by reference in its entirety.

FIELD OF INVENTION

The present invention relates to a wetting unit, to a forming machine equipped with such a wetting unit, and to a forming method for producing unit dose articles.

More particularly the invention is directed to the production of unit dose pods or pouches including two water-soluble films sealingly enclosing therebetween household care compositions, such as laundry detergents, dishwasher detergents, softeners, and other compositions used in household appliances.

In the following description reference will be made to this specific field without however losing generality.

BACKGROUND AND PRIOR ART

Laundry and dishwasher detergent pods, such as generally known for instance from US2017/2982186A1, are water-soluble pouches containing highly concentrated laundry detergents, softeners, and other laundry products. Detergent pods are becoming increasingly popular in view of the ease of use for the user and the positive impact on sustainability as they are a way to reduce wasted use of powdered and liquid detergent by having precise measurements for a load.

Detergent pods are generally produced, as disclosed for instance in US2015/336692A1 and WO2015179584-A1, by forming recesses in a first water-soluble film ("bottom film"), filling the recesses with fluid compositions, applying a second water-soluble film ("top film") over the first water-soluble film, and joining the first and second water-soluble films to each other so as to sealingly enclose the compositions between the two water-soluble films.

Joining between the two water-soluble films is performed by watering the surface of one water soluble film, prior to coupling it with the other water-soluble film after supplying the composition into the recesses of the first water-soluble film. The wetted water-soluble film is thus applied and contacted over the other water-soluble film and sealed thereto.

According to the prior art the water-soluble film which is wetted is typically the second one, i.e. the "top" film, and watering thereof is carried out in three different modes.

In a first mode, disclosed for instance in EP1641865A1, a mist of an atomized aqueous composition is applied onto the surface of the water-soluble film by a number of spraying nozzles.

In a second mode a sponge roller rotatably contacting the water-soluble film during advancement thereof supplies the aqueous composition continuously fed to its interior by means of a rotary manifold connected to the roller axis.

According to a third mode a rotating felt roller tapping into an aqueous composition basin is tangentially contacting the water-soluble film during advancement thereof.

In all above three known modes the aqueous composition is applied onto the entire surface of the second water-soluble film even if coupling thereof with the first water-soluble film would require than only a few areas thereof, namely perimetral areas, to be watered. This may cause some degradation of the two water-soluble films, whose material (typically PVA) is highly influenced by moisture, at the areas thereof which are not coupled and welded to each other.

Moreover, in all three known modes a precisely controlled traction drawing of the second water-soluble film during advancement thereof is required in order to avoid generation of creases which may prevent a uniform application of the water layer.

Additionally the second known mode is also constructively complicated owing to the provision of the rotary manifold.

OBJECT AND SUMMARY OF THE INVENTION

The object of the present invention is to overcome one or more of the problems of the prior art.

According to the present invention, this object is achieved by a forming machine for producing unit dose articles as set forth in claim 1 and in the subclaims depending thereupon.

According to another aspect, the present invention is directed to a method for producing unit dose.

According to a further aspect, the present invention relates to a wetting unit to be employed in the machine and in the method for producing unit dose articles.

The claims form an integral part of the technical disclosure provided here in relation to the invention.

BRIEF DESCRIPTION OF THE DRAWINGS

The present invention will now be described in detail with reference to the attached drawings, given purely by way of non-limiting example, wherein.

It should be appreciated that the attached drawings are schematic and various figures may not be represented in the same scale. Also, in various figures some elements may not be shown to better show other elements.

DETAILED DESCRIPTION

Figure 1:
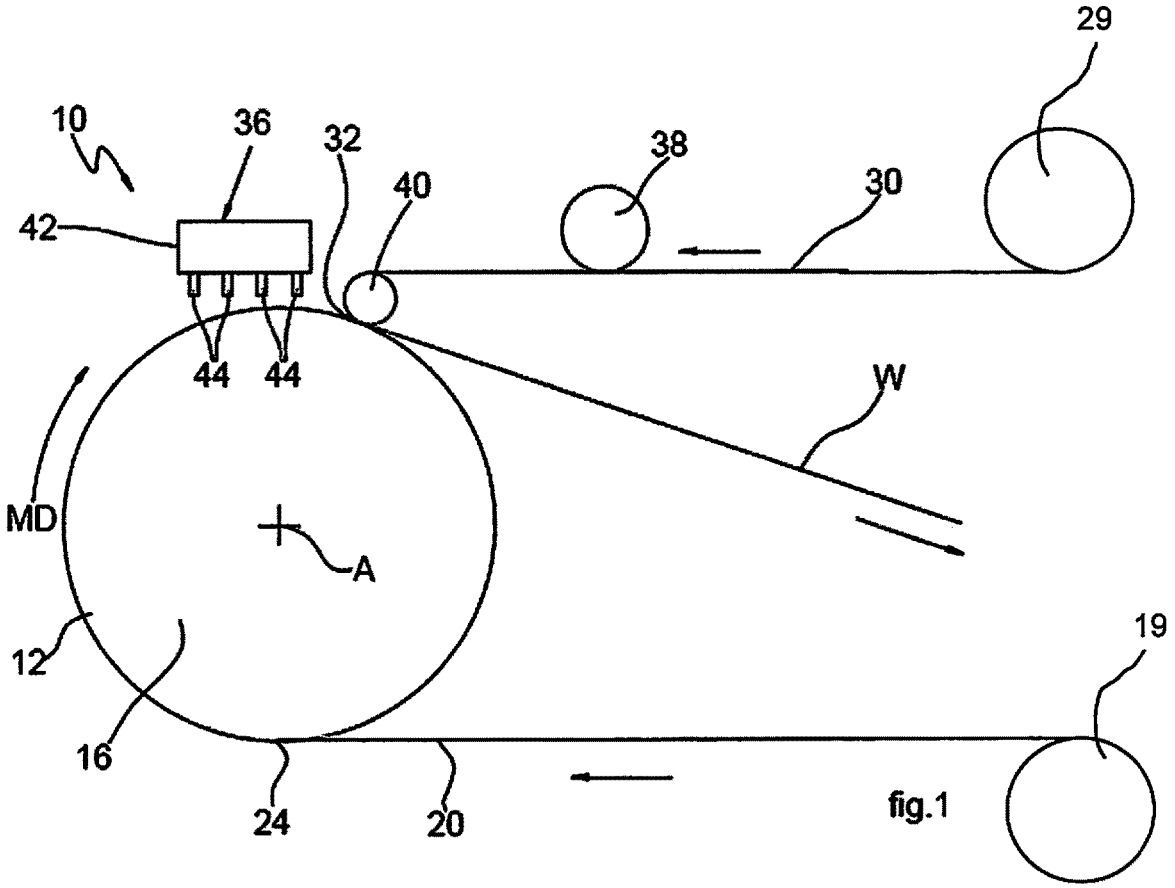
FIG. 1 is a schematic side view of a forming unit of a machine for producing unit dose articles according to the prior art.

FIG. 1 is a schematic side view of part of a machine for producing unit dose articles according to the prior art disclosed in the above, consisting of a forming unit generally indicated as 10 and comprising a forming surface 12 having a plurality of rows of cavities 14 and continuously movable in a machine direction MD. The forming surface 12 of the forming unit 10 in this case is the outer cylindrical surface of a drum 16 rotating about a horizontal axis A. In a different embodiment the forming surface 12 may be the outer surface of a closed-loop belt having a horizontal upper section and a lower return section.

Figure 2:
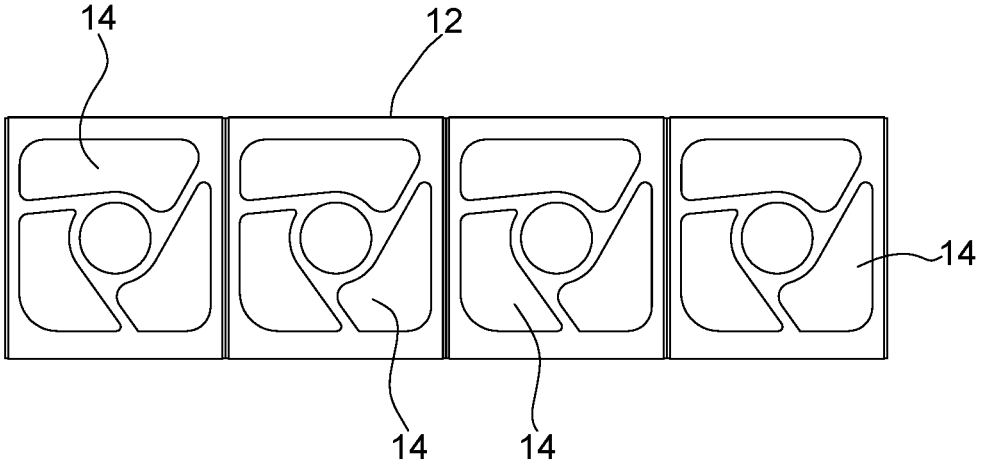
FIG. 2 is a diagrammatic plan and enlarged view showing an exemplary pattern of the forming surface of the forming unit.

FIG. 2 diagrammatically depicts one example of the pattern of one row of shaped recesses 14 of the forming surface 12.

The forming unit 10 comprises a first feeding assembly comprising a first reel 19 (FIG. 1) configured for feeding a first (top) continuous water-soluble film 20 at a first position 24 on the forming surface 12. The first continuous water-soluble film 20 is retained on the forming surface 12 and is deformed into the cavities 14 of the forming surface 12 as it moves in the machine direction MD, so as to form corresponding recesses. The deformation of the first continuous water-soluble film 20 into the cavities 14 can be provided by a suction system.

A second feeding assembly including a second reel 29 (FIG. 1) is configured for feeding a second (bottom) continuous water-soluble film 30 on the forming surface 12 at a second position 32 located downstream of the first position 24 with respect to the machine direction MD.

The unit 10 comprises a dosing apparatus 36 located above the forming surface 12, in a position intermediate between the first position 24 and the second position 32, configured for dispensing dosed quantities of at least one fluid composition into the recesses of the first continuous water-soluble film 20 which are set within the cavities 14 of the forming surface 12.

The dosing apparatus 36 typically includes one or more dosing units each comprising a movable support body 42 carrying a plurality of nozzles 44 connected to a fluid delivery system via respective flexible tubes and having respective fluid delivery apertures facing downwardly.

After the recesses of the first continuous water-soluble film 20 have been filled with the fluid compositions by the dosing apparatus 36, the second continuous water-soluble film 30 is applied at the second position 32 onto the first continuous water-soluble film 20 by a coupling roller 40 at the second position 32, so as to form an assembled web W enclosing the dosed quantities of fluid compositions contained within the recesses between the first and second continuous water-soluble films 20, 30. The assembled web W is then deviated outwardly from the forming surface 12 by the coupling roller 40.

In order to sealingly couple the first and second continuous water-soluble films 20, 30 to each other, the forming unit 10 comprises a wetting unit configured for wetting the surface of the second continuous water-soluble film 30 upstream of the second position 32. The known wetting unit comprises a wetting roller 38 which is in contact with the entire surface of the second continuous water-soluble film 30.

In a different known arrangement the wetting unit comprises a number of nozzles spraying a mist of an atomized aqueous composition onto the whole surface of the second water-soluble film 30.

The first and second continuous water-soluble films 20, 30 are then water-sealed to each other at respective contact areas surrounding the recesses containing the dosed fluid compositions.

As already explained in the above, this known arrangement has several drawbacks which are overcome by the invention as disclosed herebelow in connection to FIGS. 3-6, in which parts identical or similar to those already disclosed with reference to FIG. 1 are indicated by the same numerals.

In general terms the wetting unit of the forming machine according to the invention is configured to wet only the surface areas of one of the first or second continuous water-soluble films 20, 30 which shall be sealed to the other, thus excluding at least the recesses formed by the cavities 14.

Accordingly, the wetting unit of the invention as shown in FIGS. 3 to 6 is configured to wet only surface areas of the first continuous water-soluble films 20 which are to be put into contact and joined to the second continuous water-soluble films 30.

The wetting unit of FIGS. 3-6 consists of a sponge 46 soaked with an aqueous composition delivered by a supply dosing system, not shown in detail since within the skill of the practitioner, and touching on the first water-soluble film 20 upstream of the coupling roller 40 with respect to the machine direction MD.

Figure 4:
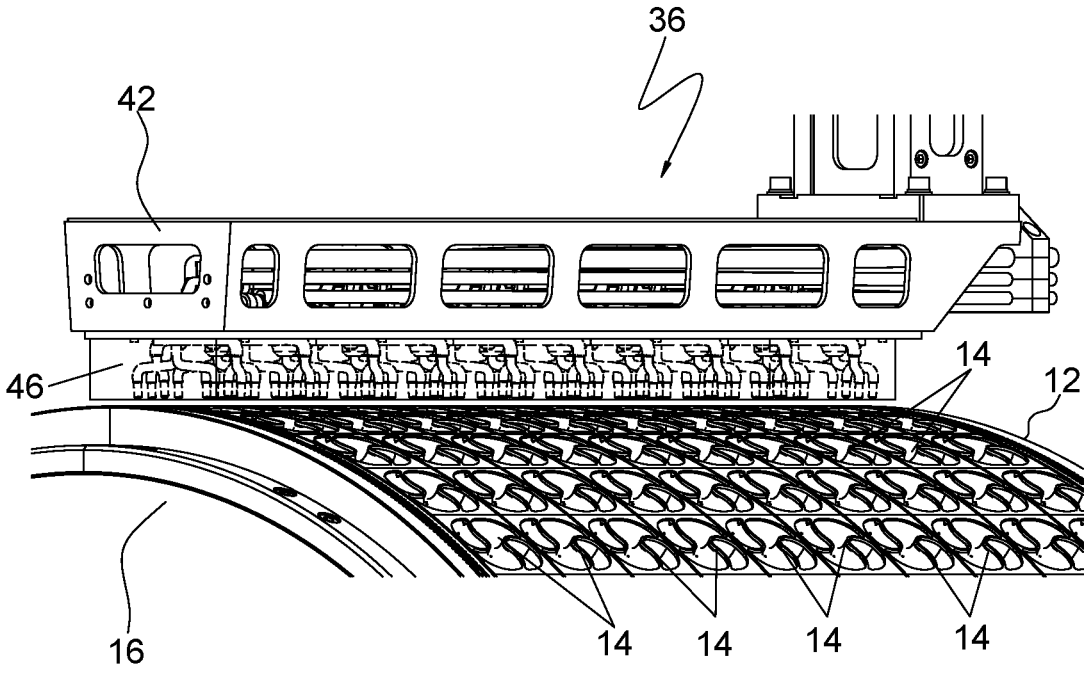
FIG. 4 is a perspective and enlarged view showing a part of the machine unit of FIG. 2.
Figure 5:
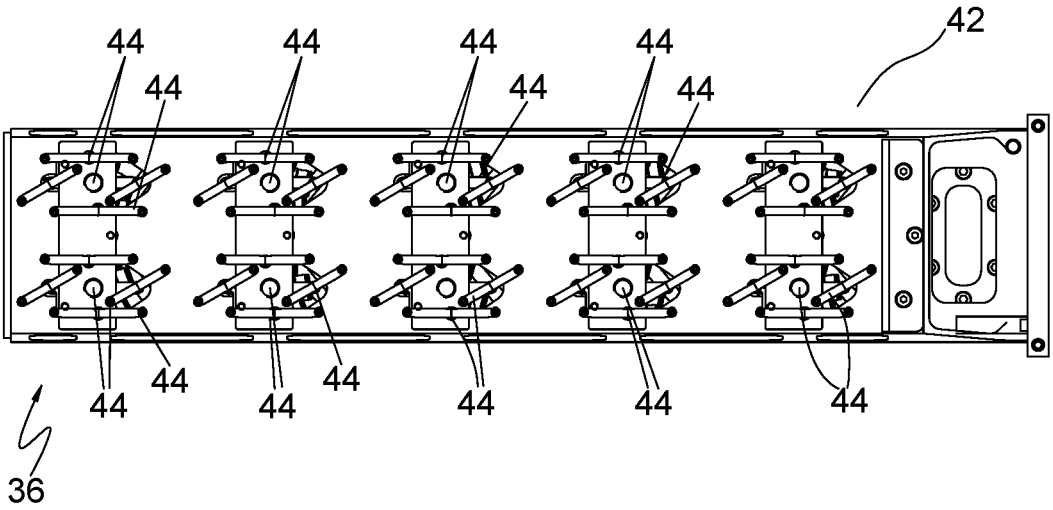
FIG. 5 is a plan view from above of the part of FIG. 4.
Figure 6:
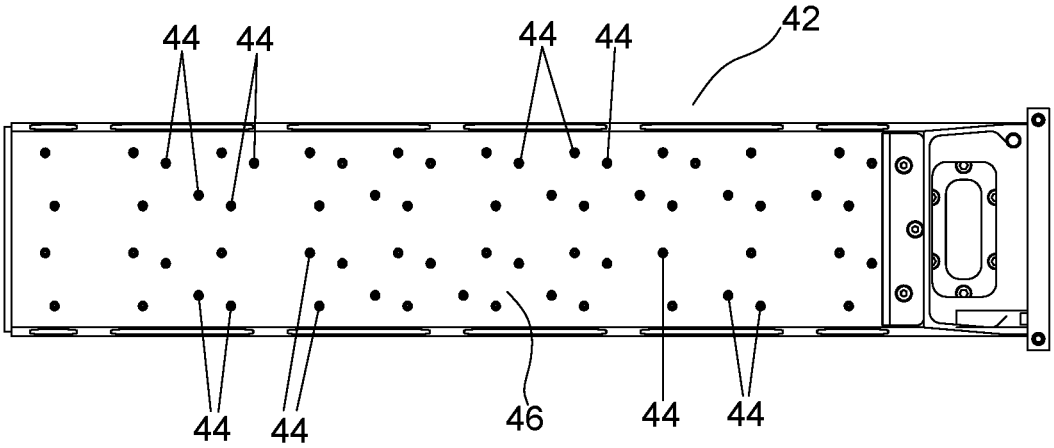
FIG. 6 is a plan view from below of the part of FIG. 5, and FIGS. 7 and 8 show two variants of the forming unit of the machine for producing unit dose articles according to the invention.

As shown in better detail in FIGS. 4 and 5 the sponge 46 is carried by the support body 42 of the dosing unit 36 located transversely above the forming surface 12 of the roller 16 and is passed through by the nozzles 44, whose fluid delivery apertures are substantially flush with the surface of the sponge 46 facing the forming surface 12.

The sponge 46 is tangent to the forming surface 12 and is thus contacting only the perimetral areas of the surface of the first water-soluble film 20 which are enclosing the recesses thereof set within the cavities 14.

The main advantages of the invention as disclosed in the above over the prior art reside in the following:

- since watering is not applied at areas of the first water-soluble film 20 which are not designed to be coupled with the second water-soluble film 30, namely not to the recesses corresponding to the cavities 14, degradation of those areas is effectively prevented and a final product (pod) of better quality can thus be obtained;
- no rotary manifold is required to supply the aqueous composition to the wetting unit;
- since wetting is performed simultaneously with filling the recesses of the first water-soluble film with the fluid compositions operated by the dosing apparatus, the physical distance and the time gap between watering and mutual coupling between the two water-soluble films is shortened, whereby the risk of generating non properly wet or even dry zones is appreciably reduced;
- since wetting is performed while the first water-soluble film is adhering to the forming surface of the roller by suction, any plies or non-uniformities of the first water-soluble film are drastically reduced or even eliminated thus improving the application of an homogeneous water veil on the planar surface of the water-soluble film;
- supplying and dosing the aqueous solution to the sponge is easier and can be carried out almost instantaneous by providing a feedback system.

Figure 3:
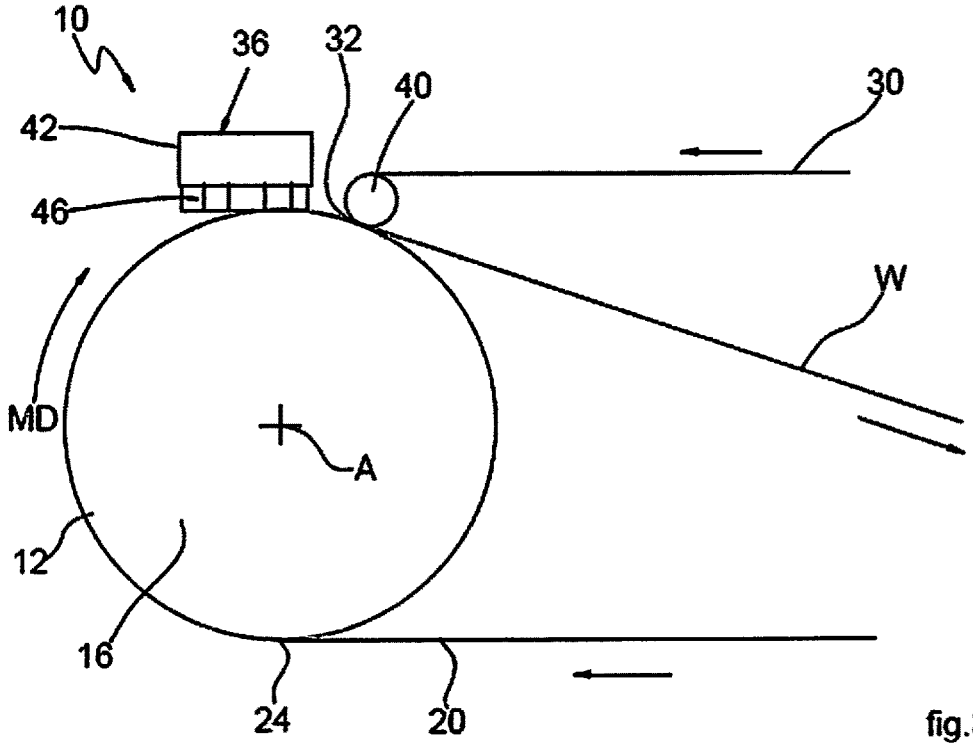
FIG. 3 is a schematic side view the same forming unit of a machine for producing unit dose articles according to the invention.
Figure 7:
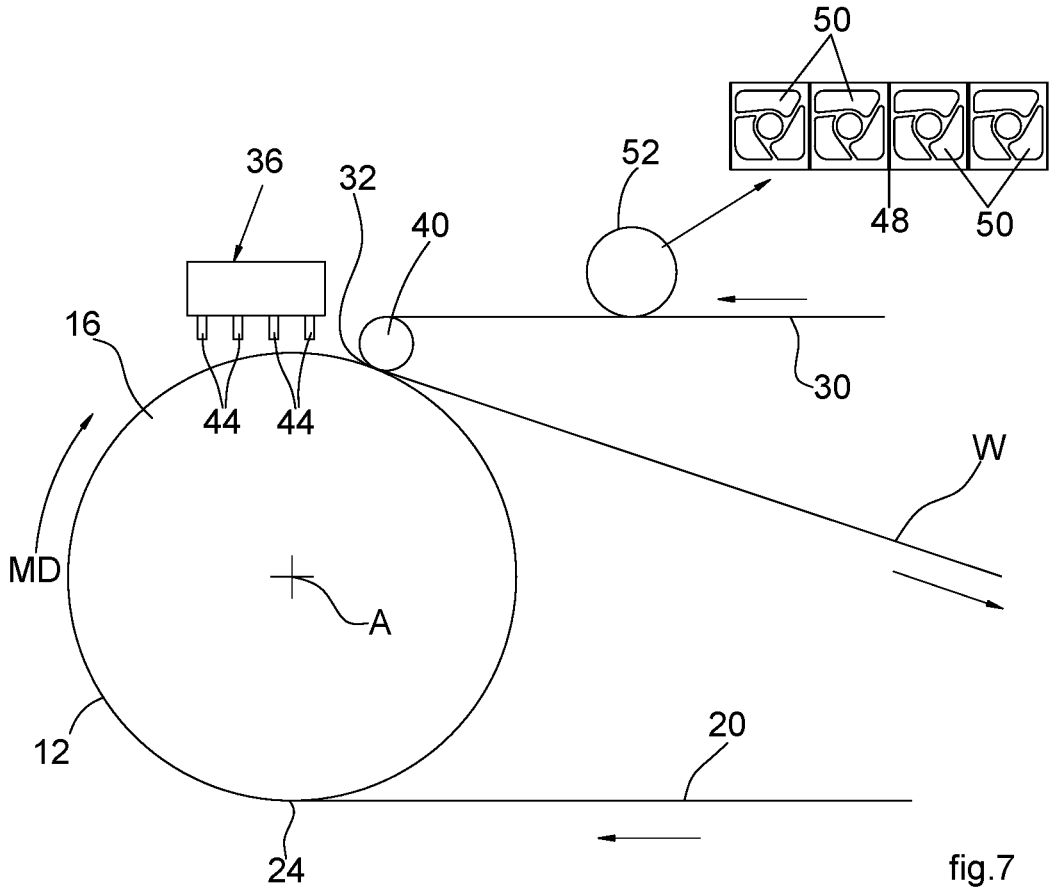
Figure 8:
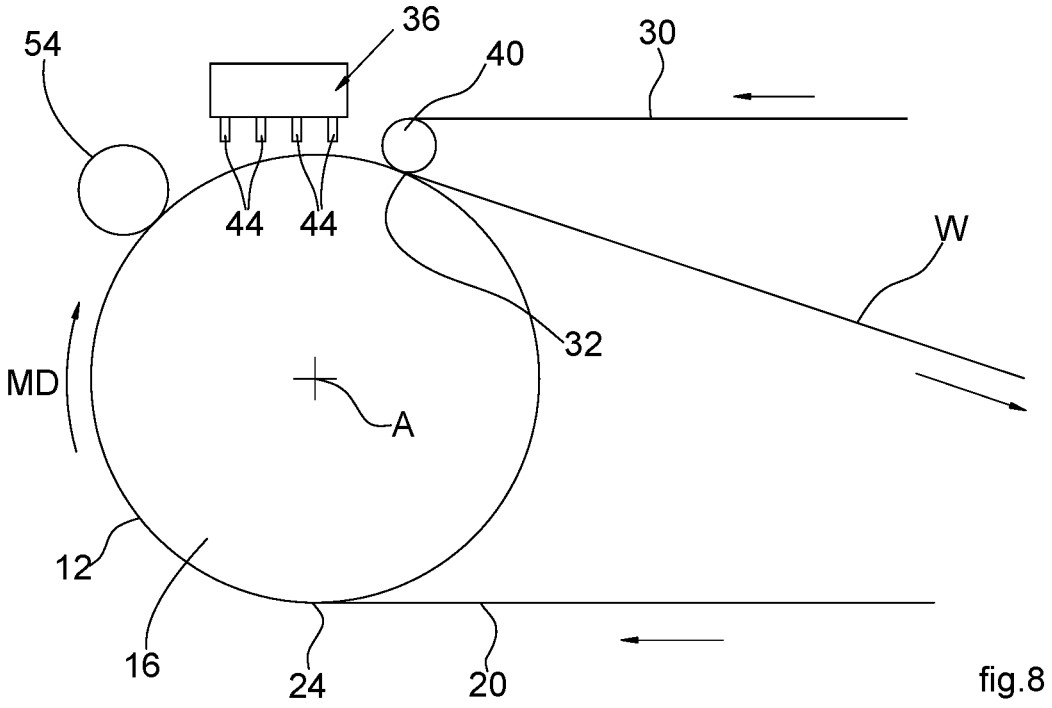

FIGS. 7 and 8, wherein parts identical or similar to those already disclosed with reference to FIG. 3 are indicated by the same numerals, are depicting two alternative embodiments of the invention according to which the sponge 46 is replaced by a wet roller. Also in both variants the arrangement is such that only the surface areas of the continuous water-soluble films 20, 30 which are to be mutually coupled are being watered.

In the embodiment of FIG. 7 a wet roller 52 is contacting on the second water-soluble film 30 upstream of the second position 32, as in the prior art of FIG. 1. Its outer surface is shaped same as that of the forming surface 12 of the forming unit 10 previously disclosed with reference to FIG. 2.

Namely, in order to contact only the areas of the surface of the second water-soluble film 30 designed to be coupled to and joined with the first water-soluble film 20, as diagrammatically shown in the detail on the right upper side of FIG. 7, only perimetral zones 48 of the roller 52 enclosing recesses 50 thereof complementary to the cavities 14 of the forming surface 12 touching on the surface of the second water-soluble film 30. In this case the advancement of the second water-soluble film 30 has to be synchronized with the advancement of the first water-soluble film 20 on the forming surface 12.

In the variant of FIG. 8 a wet roller 54 is contacting on the surface of the first water-soluble film 20 over the forming surface 12 upstream of the dosing apparatus 36, with reference to the machine direction MD. Watering performed by the wet roller 54 is thus applied onto the areas of the first water-soluble film 20 which are not designed to be coupled with and joined to the second water-soluble film 30, namely not to the recesses thereof corresponding to the cavities 14 of the forming surface 12.

Of course, without prejudice to the principle of the invention, the details of construction and the embodiments can be widely varied with respect to those described and illustrated, without thereby departing from the scope of the invention as defined by the claims that follow.

The invention claimed is:

1. A machine for producing unit dose articles, comprising:

a forming unit including a forming surface having a plurality of cavities, continuously movable in a machine direction, first feeding means for feeding a first continuous water-soluble film on said forming surface at a first position, a dosing apparatus located downstream of said first position and configured for dispensing dosed quantities of at least one fluid composition into said plurality of cavities;

second feeding means for feeding a second continuous water-soluble film on said forming surface at a second position located downstream of said dosing apparatus and joining said second continuous water-soluble film onto said first continuous water-soluble film so as to enclose said dosed quantities of fluid composition between said first continuous water-soluble film and said second continuous water-soluble film, and a wetting unit for wetting a surface of one of said first continuous water-soluble film and said second continuous water-soluble film upstream of said second position, wherein said wetting unit is configured to wet only surface areas of said one of said first continuous water-soluble film and said second continuous water-soluble film which are to be joined to the other of said first continuous water-soluble film and said second continuous water-soluble film, and wherein said wetting unit comprises a wet roller contacting on said first water-soluble film over said forming surface upstream of said dosing apparatus.

2. The machine according to claim 1, wherein said dosing apparatus comprises a support located transversely above said forming surface and carrying a number of nozzles, wherein said sponge is carried by said support of the dosing apparatus and is passed through by said nozzles.

3. A machine for producing unit dose articles comprising:

a forming unit including a forming surface having a plurality of cavities, continuously movable in a machine direction, first feeding means for feeding a first continuous water-soluble film on said forming surface at a first position, a dosing apparatus located downstream of said first position and configured for dispensing dosed quantities of at least one fluid composition into said plurality of cavities, second feeding means for feeding a second continuous water-soluble film on said forming surface at a second position located downstream of said dosing apparatus and joining said second continuous water-soluble film onto said first continuous water-soluble film so as to enclose said dosed quantities of fluid composition between said first continuous water-soluble film and said second continuous water-soluble film, and a wetting unit for wetting a surface of one of said first continuous water-soluble film and said second continuous water-soluble film upstream of said second position, wherein said wetting unit is configured to wet only surface areas of said one of said first continuous water-soluble film and said second continuous water-soluble film which are to be joined to the other of said first continuous water-soluble film and said second continuous water-soluble film, wherein said wetting unit comprises a wet sponge touching on said first water-soluble film over said forming surface.

4. A method for producing unit dose articles, comprising:

providing a forming surface having a plurality of cavities, continuously movable in a machine direction, feeding a first continuous water-soluble film on said forming surface at a first position, retaining said first continuous water-soluble film on said forming surface as it moves in said machine direction and forming a plurality of recesses in said first continuous water-soluble film by keeping said first continuous water-soluble film adherent to said plurality of cavities, delivering dosed quantities of fluid products into said plurality of recesses, applying a second continuous water-soluble film on said first water-soluble film at a second position located downstream of the first position and joining said first and second water-soluble films to each other by water-sealing around said plurality of recesses so as to enclose said dosed quantities of fluid composition between said first continuous water-soluble film and said second continuous water-soluble film, wherein water sealing is carried out by wetting only surface areas of said one of said first continuous water-soluble film and said second continuous water-soluble film which are to be joined to the other of said first continuous water-soluble film and said second continuous water-soluble film, and wherein the wetting is performed by a wet sponge touching on said first water-soluble film over said forming surface upstream of said second position.

5. The method of claim 4, wherein the wetting is carried out simultaneously with delivering said dosed quantities of fluid products into said plurality of recesses.

* * * * *